US005421582A

United States Patent [19]

Ritter

[11] Patent Number: 5,421,582

[45] Date of Patent: Jun. 6, 1995

[54] EXPANDED CHESS GAME AND METHOD THEREFOR

[76] Inventor: Carl E. Ritter, 6400 E. Cholla, Scottsdale, Ariz. 85254

[21] Appl. No.: 187,896

[22] Filed: Jan. 28, 1994

[51] Int. Cl.[6] ..... A63F 3/02

[52] U.S. Cl. ..... 273/261; D21/24

[58] Field of Search ..... 273/261, 260

[56] References Cited

U.S. PATENT DOCUMENTS 3,610,626 10/1971 Nolte ..... 273/261

4,052,069 10/1977 Sandhu ..... 273/261

4,229,008 10/1980 Jameson ..... 273/261

*Primary Examiner*—Benjamin H. Layno

*Attorney, Agent, or Firm*—Harry M. Weiss

[57] ABSTRACT

A new, expanded chess game is disclosed which provides a game board having an upper surface for playing the expanded chess game and a first and a second set of game pieces for use by a first and a second player, respectively. The playing surface provides a unique octagonal shape comprised of a plurality of squares over which the game pieces move. Each set of game pieces includes the standard set of chess pieces from the standard game of chess, namely a King, a Queen, two Rooks, two Bishops, two Knights, and eight Pawns, and two of a new, separate game piece called the Viceroy. Each of the standard chess pieces operate in accordance with the rules of standard chess with the exception that the castling procedure is not permitted in the expanded chess game. The new, Viceroy game pieces move two spaces at a time in one of a forward, backward, left, right, or diagonal motion. The combination of the new, expanded octagonal playing surface with the new Viceroy game piece provides a new, expanded chess game having a greater number of potential game scenarios.

14 Claims, 2 Drawing Sheets

EXPANDED CHESS GAME AND METHOD THEREFOR

BACKGROUND OF THE INVENTION

1. Field of the Invention

This invention relates generally to games and, more specifically, to an expanded chess game and method therefor which provides a new, octagonally shaped playing surface, standard game pieces from the standard game of chess, and a new game piece called the Viceroy.

2. Description of the Related Art

The standard game of chess is well known. In fact, many chess players believe that the game is all too well known. In particular, throughout the lengthy history of the standard game of chess, it has been played an extremely large number of times. Consequently, it is not surprising to find that many, if not all, of the potential game scenarios have already been played. In fact, most serious chess players have studied the results of previously executed chess game strategies, and as a result, the excitement of the game is somewhat dulled.

The standard game of chess provides a square shaped playing surface comprised of 64 squares which typically alternate between black and red, two sets of game pieces, each including a King, a Queen, two Rooks, two Bishops, two Knights, and eight Pawns, and rules governing the play of the chess game. At the beginning of a standard game of chess, there are only 4 rows of 8 squares separating the opposing game pieces, therefore, the players are, to a large degree, forced into directly and quickly confronting their opponent's game pieces. Of course, ultimately, that is an important aspect of the game, however, the relatively close quarters arrangement between opposing game pieces in the standard game of chess precludes a more diversionary, indirect style of play. An example of an indirect style of play might include, moving or "hiding" one or more a first player's high value game pieces, such as the Queen or the Rook, away from the majority of their game pieces. The idea behind this sort of strategy is to hopefully draw the second player's attacking game pieces toward the majority of the first player's game pieces in order to preoccupy the second player into forgetting about the "hidden" game piece(s). When this strategy is executed properly, the first player can take advantage of the second player by using the "hidden" game piece(s) to capture valuable game pieces belonging to the second player. While direct confrontation is a useful strategy in the standard game of chess, so too is indirect engagement, however, due to the relatively small, confined playing surface in the standard game of chess, this sort of indirect, diversionary attack is difficult to execute.

Therefore, a need existed to provide an expanded chess game providing an enlarged playing surface having side portions where game pieces can be moved in order to set up this diversionary tactic. When a more expansive playing surface is implemented, there are far more scenarios possible in the new, expanded game of chess than in the standard game of chess, and consequently, a greater challenge exists for more serious chess players.

In general, in order to add greater strategic flexibility and intellectual challenge for players of the game of chess, there existed a need to provide not only a new and more expansive playing surface, but also a new game piece to cover the new expanded playing surface of the new, expanded chess game.

SUMMARY OF THE INVENTION

In accordance with one embodiment of this invention, it is an object of this invention to provide a new, expanded chess game.

It is another object of this invention to provide a method of playing a new, expanded chess game.

It is a further object of this invention to provide a new playing board surface having a playable area that is larger in the number of playable squares and different in shape from the playing board surface of a standard chess game in order to expand the number of options available to the players of the new, expanded chess game.

It is yet another object of this invention to provide a new playing piece having moving and capturing characteristics unlike any previously defined game piece in the standard game of chess.

BRIEF DESCRIPTION OF THE PREFERRED EMBODIMENTS

In accordance with one embodiment of this invention, an expanded chess game for use by a first player against a second player with each player using game pieces is disclosed comprising, in combination, a game board having an upper surface for playing the expanded chess game, the upper surface having an octagonal shape comprising a plurality of squares over which the game pieces move, the game pieces comprising a first and a second set of game pieces respectively used by the first player and the second player for playing the expanded chess game on the game board with each set of game pieces including a standard set of game pieces from a standard chess game, and the first and second set of game pieces each including at least one new, separate game piece for playing the expanded chess game on the game board, each new, separate game piece having a movement on the game board defined by moving an amount equal to two of the squares away from a square that the new, separate game piece is resting on in one direction of a forward motion, a backward motion, a left motion, a right motion, and a diagonal motion. The upper surface having the octagonal shape comprising the plurality of squares is defined by a plurality of parallel and adjacent rows of the squares including a first row of 4 of the squares, a second row of 6 of the squares, a third row of 8 of the squares, a fourth row of 10 of the squares, a fifth row of 12 of the squares, a sixth row of 14 of the squares, a seventh row of 14 of the squares, an eighth row of 14 of the squares, a ninth row of 14 of the squares, a tenth row of 12 of the squares, an eleventh row of 10 of the squares, a twelfth row of 8 of the squares, a thirteenth row of 6 of the squares, and a fourteenth row of 4 of the squares, each of the squares being colored by one of a first color and a second color. In addition, each row of the plurality of parallel and adjacent rows of the squares when viewed by moving a single square at a time from a first end square to an opposite end square for each of the plurality of rows defines a color pattern that alternates between the first color and the second color, and the color pattern defines an unchanging color pattern of one of the first color and the second color when viewed by moving diagonally between any two of the squares. The standard set of game pieces from the standard chess game includes a King, a Queen, two Rooks, two Knights, two Bishops, and eight Pawns and each game piece of the standard set of game pieces from the standard chess game operates in the expanded chess game according to all rules governing play of the standard set of game pieces in the standard chess game except that a procedure know as castling from the standard chess game is not allowed in the expanded chess game. In the expanded chess game, a first of the two squares of the movement of the new, separate game piece must be without any game piece thereon in order to permit the movement. In addition, the movement of the new, separate game piece by the two squares in order to land on a square having any game piece of an opponent's game pieces thereon provides capture and thereby permits removal of the game piece of the opponent's game pieces from the game board. This new, separate game piece is called a Viceroy, and the Viceroy has a lower base supporting portion, an elongated mid-section portion, and a substantially V-shaped upper portion. The first player has the standard set of game pieces and two of the Viceroy of the first color, and the second player also has the standard set of game pieces and two of the Viceroy of the second color. In the expanded chess game, the first player initially places 4 of their game pieces in the first row from left to right as Viceroy, King, Queen, and Viceroy, 6 of their game pieces in the second row from left to right as Rook, Knight, Bishop, Bishop, Knight, and Rook, and 8 of their Pawns in the third row, and the second player initially places 4 of their game pieces in the fourteenth row from left to right as Viceroy, Queen, King, and Viceroy, 6 of their game pieces in the thirteenth row from left to right as Rook, Knight, Bishop, Bishop, Knight, and Rook, and 8 of their Pawns in the twelfth row. When any Pawn of the first player's 8 Pawns reaches one of the 4 squares of the fourteenth row, one of an end square and an opposite end square of the thirteenth row, the twelfth row, the eleventh row, the tenth row, and the ninth row, the first player can have the Pawn become one of a Queen, a Viceroy, a Rook, a Knight, and a Bishop, and when any Pawn of the second player's 8 Pawns reaches one of the 4 squares of the first row, one of an end square and an opposite end square of the second row, the third row, the fourth row, the fifth row, and the sixth row, the second player can have the Pawn become one of a Queen, a Viceroy, a Rook, a Knight, and a Bishop.

In accordance with another embodiment of this invention, a method of playing an expanded chess game for use by a first player against a second player with each player using game pieces is provided comprising the steps of providing a game board having an upper surface for playing the expanded chess game, and the upper surface having an octagonal shape comprising a plurality of squares over which the game pieces move, providing the game pieces comprising a first and a second set of game pieces respectively used by the first player and the second player for playing the expanded chess game on the game board with each set of game pieces including a standard set of game pieces from a standard chess game, and providing the first and second set of game pieces each including at least one new, separate game piece for playing the expanded chess game on the game board, each new, separate game piece having a movement on the game board defined by moving an amount equal to two of the squares away from a square that the new, separate game piece is resting on in one direction of a forward motion, a backward motion, a left motion, a right motion, and a diagonal motion.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
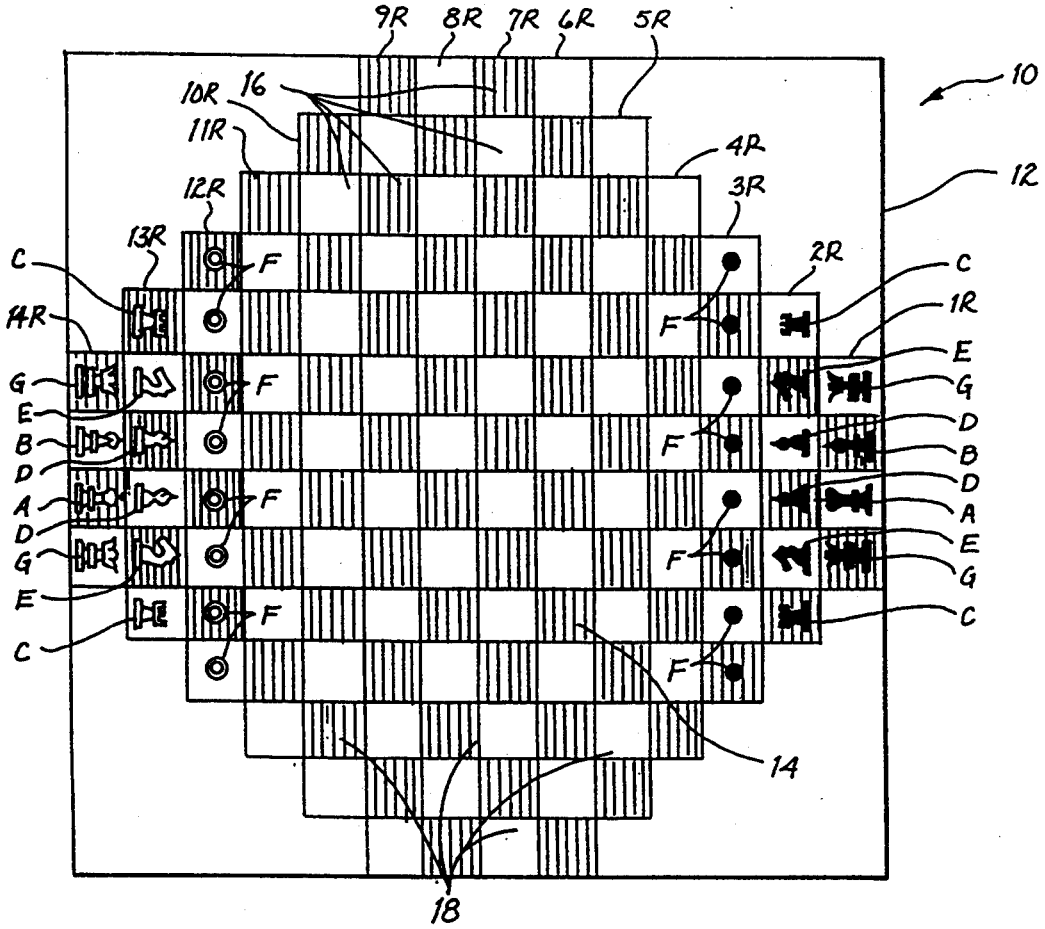
FIG. 1 is a plan view of the new, expanded chess game showing the unique octagonal shape of the playing surface and showing how the game pieces are initially set up.

Referring to FIG. 1, the new, expanded chess game, or simply, the expanded chess game is shown and is generally designated by reference number 10. The expanded chess game 10 is provided with a game board 12 having a playing surface 14 thereon. The game board 12 can be manufactured in any one of a number of manners that are well known in the art of game board manufacture. For example, the game board 12 could be made out of card board or any other suitable material having colored paper, or again, any other suitable material in the shape and pattern of the playing surface 14 coupled thereon by some fastening material such as glue. In general, the game board 12 and playing surface 14 can be made in any one of a number of well known game board constructions such as a portable, foldable game board, however, no previous chess or other game board has the unique shape and size of the playing surface 14. Specifically, note that the playing surface 14 has a substantially octagonal shape comprised of 14 parallel and adjacent rows of squares, and the total number of squares is 136. Note that each row is labelled according to its respective row number; for example, row 1 is labelled 1R. Accordingly, the playing surface 14 is defined by the 14 parallel and adjacent rows 1R–14R of squares starting from row 1R having 4 squares, and continuing as row 2R having 6 squares, row 3R having 8 squares, row 4R having 10 squares, row 5R having 12 squares, row 6R having 14 squares, row 7R having 14 squares, row 8R having 14 squares, row 9R having 14 squares, row 10R having 12 squares, row 11R having 10 squares, row 12R having 8 squares, row 13R having 6 squares, and row 14R having 4 squares. Note that each row 1R–14R of squares, when viewed by moving a single square at a time from a first end square to an opposite end square for each row of rows 1R–14R, defines a color pattern that alternates between a first color and a second color, and in addition, note that moving diagonally between any 2 squares of the playing surface 14 defines an unchanging color pattern of either the first color or the second color. Typically, these colors alternate between black and red, however, other color selections, such as black and white, are permissible.

The initial placement of game pieces is also shown in FIG. 1. Specifically, assuming that a first player selects game pieces of a first color, such as black, then the first player initially places their game pieces in row 1R from left to right as Viceroy G, King A, Queen B, and Viceroy G, in row 2R from left to right as Rook C, Knight E, Bishop D, Bishop D, Knight E, and Rook C, and in row 3R, each of the first player's 8 Pawns F are placed. Similarly, assuming that a second player selects game pieces of a second color, such as white, then the second player initially places their game pieces in row 14R from left to right as Viceroy G, Queen B, King A, and Viceroy G, in row 13R from left to right as Rook C, Knight E, Bishop D, Bishop D, Knight E, and Rook C, and in row 12R, each of the second player's 8 Pawns F are placed.

Also note that in the vicinity of the end squares of rows 4R–11R are diversionary areas 16 and 18 of the playing surface 14. Diversionary area 16 extends to the right of an imaginary line drawn between the right most Pawn F in row 3R and the corresponding Pawn F directly across the playing surface 14 in Row 12R. Similarly, diversionary area 18 extends to the left of an imaginary line drawn between the left most Pawn F in row 3R and the corresponding Pawn F directly across the playing surface 14 in Row 12R. Consequently, these areas 16 and 18 of the playing surface 14 are located outside of any direct path between opposing game pieces as they are set up at the beginning of the game, and as a result, players can move some of their game pieces into these areas 16 and/or 18 in order to create a diversionary force of game pieces separated from their main grouping of game pieces. In addition, the larger number of squares, 136, comprising the playing surface 14 of the expanded chess game 10, relative to only 64 squares on a playing surface of a standard chess game, permits greater flexibility, more options, and more challenges for each player in the expanded chess game 10.

Referring to FIGS. 2A–2F, a set of standard playing pieces from the standard game of chess is shown as King A, Queen B, Rook C, Bishop D, Knight E, and Pawn F. Each player in the expanded game of chess 10 is provided with a set of game pieces from the standard game of chess comprising 1 King A, 1 Queen B, 2 Rooks C, 2 Bishops D, 2 Knights E, and 8 Pawns F. Each of these game pieces A–F function the same in the expanded game of chess 10 as they do in the standard game of chess. It is well known in the art as to how standard chess pieces A–F are made. The standard chess pieces A–F used in the expanded chess game 10 can be made out of plastic, wood, marble, or any other suitable material.

Figure 2A:
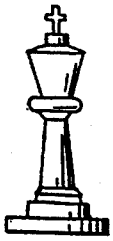
FIGS. 2A–F are perspective views of a King, a Queen, a Rook, a Bishop, a Knight, and a Pawn, respectively, from the standard chess game that are used in the new, expanded chess game.
Figure 2B:
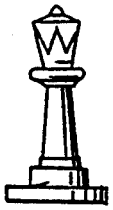
Figure 2C:
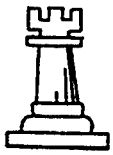
Figure 2D:
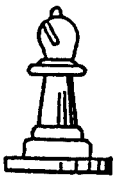
Figure 2E:
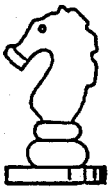
Figure 2F:
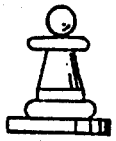
Figure 2G:
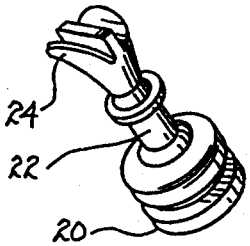
FIG. 2G is a perspective view of the new Viceroy game piece used in the new, expanded chess game.

In FIG. 2G, a new game piece called the Viceroy is shown. In addition to the set of game pieces from the standard game of chess that each player is given in the expanded game of chess 10, they are also each given 2 of the new Viceroy G game pieces. The Viceroy G is made in a similar manner and out of the same type of material that is selected for the manufacture of game pieces A–F. In general, the Viceroy G is made to resemble the game piece as shown in FIG. 2G having a lower base supporting portion 20, an elongated mid-section portion 22, and a substantially V-shaped upper portion 24. The Viceroys G move and function in the expanded game of chess 10 unlike any other previous game piece, thereby adding another new dimension to the expanded chess game 10.

Figure 3:
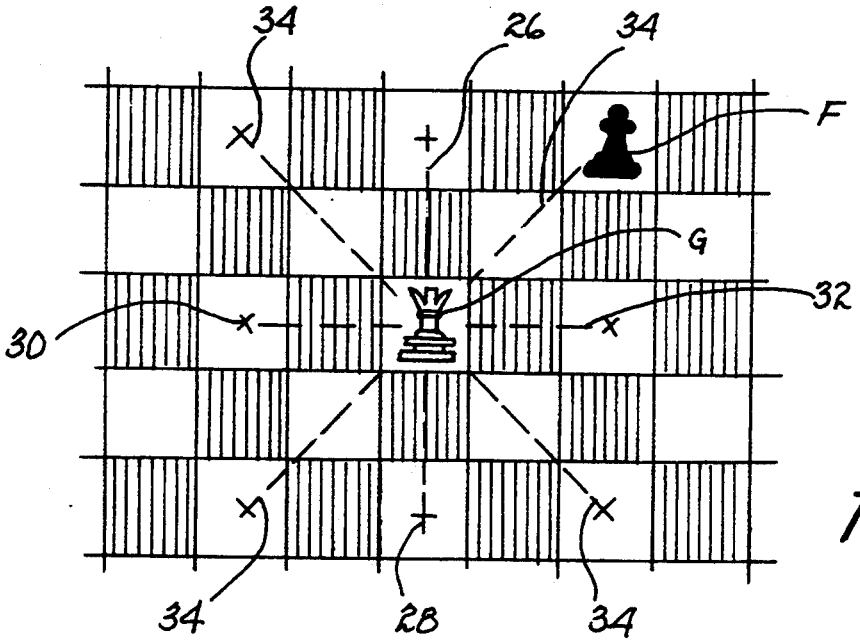
FIG. 3 is a plan view showing the manner in which the Viceroy is capable of moving upon a portion of the playing surface of the new, expanded chess game.

The potential motions of the Viceroy G are demonstrated by the dashed lines emanating from the Viceroy G in FIG. 3. In particular, the Viceroy G can only move 2 spaces at a time, but it can move in any of a forward motion 26, a backward motion 28, a left motion 30, a right motion 32, and a diagonal motion 34. Additionally, the Viceroy G cannot "jump over" another game piece. In order to capture one of a second player's game pieces with a first player's Viceroy G, the Viceroy G must move 2 spaces in order to land on the square or space having the second player's game piece thereon.

Figure 4:
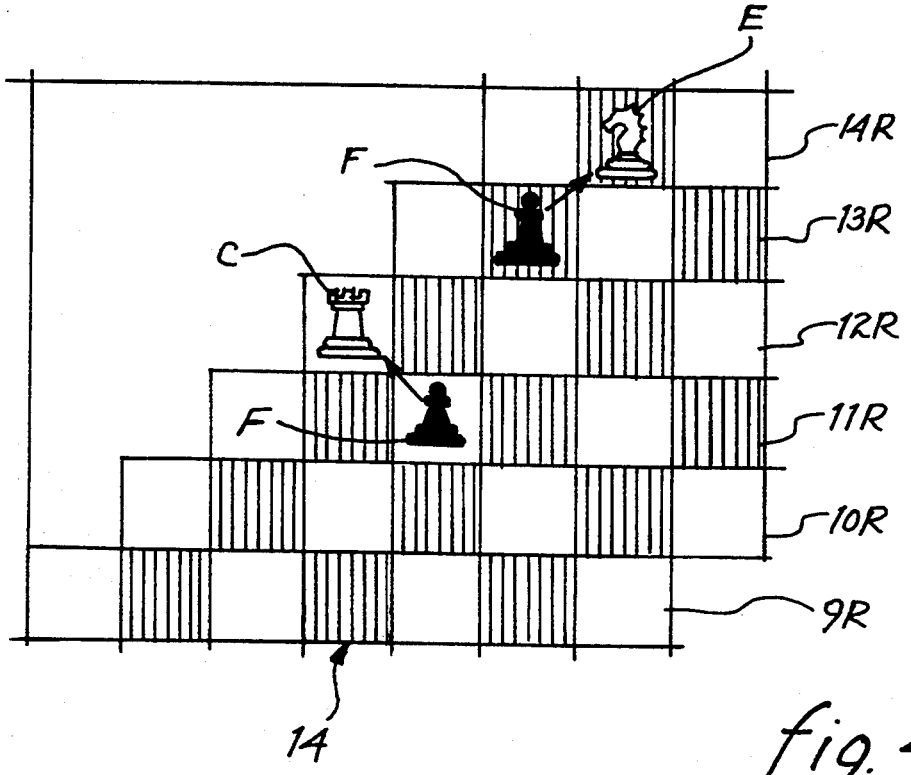
FIG. 4 is a plan view demonstrating how a Pawn is promoted by reaching one of an opponent's "back row" squares.

Due to the unique shape and size of the playing surface 14 of the expanded chess game 10, the process of Pawn promotion in the expanded chess game 10 is different from how it was implemented in the standard game of chess. This important difference can be visualized by referring to FIG. 4. Recalling that in the standard game of chess, when any 1 of a player's 8 Pawns F reaches any 1 of the 8 squares of their opponent's back row, then that Pawn F is "promoted" to become any type of game piece, except for the King A, that is desired by the player owning that Pawn F. In the expanded game of chess 10, when any 1 of a player's 8 Pawns F reaches any 1 of 14 particular squares, then that Pawn F is "promoted" as it would in the standard game of chess. The big difference is that in the expanded game of chess 10, there are 14, as opposed to only 8, squares that can cause Pawn promotion. In particular, when any Pawn F of a first player's 8 Pawns F crosses the playing surface 14 in order to reach 1 of the 4 squares of row 14R, or one of an end square and an opposite end square of row 13R, 12R, 11R, 10R or 9R, then the first player's Pawn F is promoted to one of a Queen B, a Viceroy G, a Rook C, Knight E, and a Bishop D. Analogously, when any Pawn F of a second player's 8 Pawns F reaches 1 of the 4 squares of row 1R, or one of an end square and an opposite end square of the row 2R, 3R, 4R, 5R, or 6R, then the second player's Pawn F can be promoted to become one of a Queen B, a Viceroy G, a Rook C, a Knight E, and a Bishop D. In FIG. 4, two examples of possible Pawn promotions are shown, namely a black Pawn F capturing a white Knight E in row 14R and a black Pawn F capturing a white Rook C located on an end square of row 12R. The fact that there are 14 potential Pawn promotion squares for each player in the expanded chess game 10, as opposed to only 8 in the standard game of chess, means that the expanded game of chess 10 is more complex as it is more difficult to defend 14 squares than it is to defend only 8 squares. In addition, the 14 potential Pawn promotion squares for each of the players in the new game 10 are more widely spread out than the 8 Pawn promotion squares in the standard game of chess, thereby making the new, expanded game of chess 10 even more challenging than standard chess.

OPERATION

The new, expanded game of chess 10 is played in accordance with the standard rules of chess with the exception that the procedure know as castling from the standard game of chess is not permitted in expanded chess 10. The standard game of chess as well as the rules associated therewith are well known to those who play the standard game of chess, however, the "Official Rules of Chess" published by the United States Chess Federation is a well known reference that may be used to define what the rules are for the standard game of chess. Other differences between the standard game of chess and the expanded game 10, such as the rules governing Pawn promotion and movement of the new, Viceroy G, have previously been disclosed.

While the invention has been particularly shown and described with reference to the preferred embodiments thereof, it will be understood by those skilled in the art that the foregoing and other changes in form and details may be made therein without departing from the spirit and scope of the invention. For example, if desired, game pieces that look different from those shown in FIGS. 2A–2G but that function the same could be implemented. In addition, there are many different types of chess game arrangements, for example, there are portable, foldable chess boards forming a cavity for the convenient storage of the chess game pieces therein when the board is in a closed position. If desired, the new, expanded chess game 10 could implement this or other types of chess game configurations. Moreover, the standard game of chess is played not only on a mechanical type game board using mechanical game pieces, but also in an electronic format, such as the computer. Consequently, if desired, the expanded chess game 10 can be implemented not only by using a mechanical game board and game pieces, but also in an electronic form such as a computer software program which drives a visual display of the expanded chess game 10.

What is claimed is:

1. An expanded chess game for use by a first player against a second player with each player using game pieces comprising, in combination:

a game board having an upper surface for playing said expanded chess game, said upper surface having an octagonal shape comprising a plurality of squares over which said game pieces move;

said game pieces comprising a first and a second set of game pieces respectively used by said first player and said second player for playing said expanded chess game on said game board with each set of game pieces including a standard set of game pieces from a standard chess game; and said first and second set of game pieces each including at least one new, separate game piece for playing said expanded chess game on said game board, each said new, separate game piece having a movement on said game board defined by moving an amount equal to two of said squares away from a square that said new, separate game piece is resting on in one direction of a forward motion, a backward motion, a left motion, a right motion, and a diagonal motion; and wherein said upper surface having said octagonal shape comprising said plurality of squares consists of fourteen parallel and adjacent rows of said squares including a first row having only 4 of said squares, a second row having only 6 of said squares, a third row having only 8 of said squares, a fourth row having only 10 of said squares, a fifth row having only 12 of said squares, a sixth row having only 14 of said squares, a seventh row having only 14 of said squares, an eighth row having only 14 of said squares, a ninth row having only 14 of said squares, a tenth row having only 12 of said squares, an eleventh row having only 10 of said squares, a twelfth row having only 8 of said squares, a thirteenth row having only 6 of said squares, and a fourteenth row having only 4 of said squares, each of said squares being colored by one of a first color and a second color.

2. The expanded chess game of claim 1 wherein each row of said fourteen parallel and adjacent rows of said squares when viewed by moving a single square at a time from a first end square to an opposite end square for each of said fourteen rows defines a color pattern that alternates between said first color and said second color, and said color pattern defines an unchanging color pattern of one of said first color and said second color when viewed by moving diagonally between any two of said squares.

3. The expanded chess game of claim 1 wherein said standard set of game pieces from said standard chess game includes a King, a Queen, two Rooks, two Knights, two Bishops, and eight Pawns and each game piece of said standard set of game pieces from said standard chess game operates in said expanded chess game according to all rules governing play of said standard set of game pieces in said standard chess game except that a procedure known as castling from said standard chess game is not allowed in said expanded chess game.

4. The expanded chess game of claim 1 wherein said new, separate game piece is called a Viceroy, said Viceroy having a lower base supporting portion, an elongated mid-section portion, and a substantially V-shaped upper portion.

5. The expanded chess game of claim 4 wherein said first player has said standard set of said game pieces and two of said Viceroy of said first color, and said second player also has said standard set of said game pieces and two of said Viceroy of said second color.

6. A method of playing an expanded chess game for use by a first player against a second player with each player using game pieces comprising the steps of:

providing a game board having an upper surface for playing said expanded chess game, said upper surface having an octagonal shape comprising a plurality of squares over which said game pieces move;

providing said game pieces comprising a first and a second set of game pieces respectively used by said first player and said second player for playing said expanded chess game on said game board with each set of game pieces including a standard set of game pieces from a standard chess game; and providing said first and second set of game pieces each including at least one new, separate game piece for playing said expanded chess game on said game board, each said new, separate game piece having a movement on said game board defined by moving an amount equal to two of said squares away from a square that said new, separate game piece is resting on in one direction of a forward motion, a backward motion, a left motion, a right motion, and a diagonal motion; and wherein said upper surface having said octagonal shape comprising said plurality of squares consists of fourteen parallel and adjacent rows of said squares including a first row having only 4 of said squares, a second row having only 6 of said squares, a third row having only 8 of said squares, a fourth row having only 10 of said squares, a fifth row having only 12 of said squares, a sixth row having only 14 of said squares, a seventh row having only 14 of said squares, an eighth row having only 14 of said squares, a ninth row having only 14 of said squares, a tenth row having only 12 of said squares, an eleventh row having only 10 of said squares, a twelfth row having only 8 of said squares, a thirteenth row having only 6 of said squares, and a fourteenth row having only 4 of said squares, each of said squares being colored by one of a first color and a second color.

7. The method of claim 6 wherein each row of said plurality of parallel and adjacent rows of said squares when viewed by moving a single square at a time from a first end square to an opposite end square for each of said fourteen rows defines a color pattern that alternates between said first color and said second color, and said color pattern defines an unchanging color pattern of one of said first color and said second color when viewed by moving diagonally between any two of said squares.

8. The method of claim 6 wherein said standard set of game pieces from said standard chess game includes a King, a Queen, two Rooks, two Knights, two Bishops, and eight Pawns and each game piece of said standard set of game pieces from said standard chess game operates in said expanded chess game according to all rules governing play of said standard set of game pieces in said standard chess game except that a procedure know as castling from said standard chess game is not allowed in said expanded chess game.

9. The method of claim 8 wherein when any Pawn of said first player's 8 Pawns reaches one of said 4 squares of said fourteenth row, one of an end square and an opposite end square of said thirteenth row, said twelfth row, said eleventh row, said tenth row, and said ninth row, said first player can have said Pawn become one of said Queen, said Viceroy, said Rook, said Knight, and said Bishop, and when any Pawn of said second player's 8 Pawns reaches one of said 4 squares of said first row, one of an end square and an opposite end square of said second row, said third row, said fourth row, said fifth row, and said sixth row, said second player can have said Pawn become one of said Queen, said Viceroy, said Rook, said Knight, and said Bishop.

10. The method of claim 6 wherein a first of said two squares of said movement of said new, separate game piece must be without any game piece thereon in order to permit said movement.

11. The method of claim 6 wherein said movement of said new, separate game piece by said two squares lands on a square having any game piece of an opponent's game pieces thereon provides capture and thereby permits removal of said any game piece of said opponent's game pieces from said game board.

12. The method of claim 6 wherein said new, separate game piece is called a Viceroy, said Viceroy having a lower base supporting portion, an elongated mid-section portion, and a substantially V-shaped upper portion.

13. The method of claim 12 wherein said first player has said standard set of said game pieces and two of said Viceroy of said first color, and said second player also has said standard set of said game pieces and two of said Viceroy of said second color.

14. The method of claim 6 wherein said first player initially places 4 of their game pieces in said first row from left to right as Viceroy, Queen, King, and Viceroy, 6 of their game pieces in said second row from left to right as Rook, Knight, Bishop, Bishop, Knight, and Rook, and 8 of their Pawns in said third row, and said second player initially places 4 of their game pieces in said fourteenth row from left to right as Viceroy, King, Queen, and Viceroy, 6 of their game pieces in said thirteenth row from left to right as Rook, Knight, Bishop, Bishop, Knight, and Rook, and 8 of their Pawns in said twelfth row.

* * * * *